US006994657B1

(12) United States Patent
Eschenbach

(10) Patent No.: US 6,994,657 B1
(45) Date of Patent: Feb. 7, 2006

(54) ELLIPTICAL EXERCISE MACHINE

(76) Inventor: Paul William Eschenbach, 290 S. Tyger La., Roebuck, SC (US) 29376

( * ) Notice: Subject to any disclaimer, the term of this patent is extended or adjusted under 35 U.S.C. 154(b) by 0 days.

(21) Appl. No.: 11/081,398

(22) Filed: Mar. 17, 2005

(51) Int. Cl.
*A63B 22/04* (2006.01)
*A63B 69/16* (2006.01)

(52) U.S. Cl. ..... 482/52; 482/51; 482/57

(58) Field of Classification Search ..... 482/51–53, 482/57, 70, 79–80
See application file for complete search history.

(56) References Cited

U.S. PATENT DOCUMENTS 5,788,610 A * 8/1998 Eschenbach ..... 482/52
5,957,814 A 9/1999 Eschenbach ..... 482/51
5,997,445 A 12/1999 Maresh et al. ..... 482/70
6,077,198 A * 6/2000 Eschenbach ..... 482/52
6,168,552 B1 1/2001 Eschenbach ..... 482/52
6,436,007 B1 8/2002 Eschenbach ..... 482/52
6,440,042 B2 8/2002 Eschenbach ..... 482/52

* cited by examiner

*Primary Examiner*—Stephen R. Crow

(57) ABSTRACT

The present invention relates to a standup exercise apparatus that simulates walking, jogging and climbing with arm exercise. More particularly, the present invention relates to an exercise machine having separately supported pedals for the feet and arm exercise coordinated with the motion of the feet. Elliptical cross trainers guide the feet along a generally elliptical shaped curve to simulate the motions of jogging and climbing. Existing elliptical cross trainers often use excessive pedal articulation which can overwork the ankle to achieve a longer stride. The present invention is an improved elliptical exercise machine capable of extended exercise with less pedal articulation that is more ankle friendly. One end of a foot support member has a pedal which follows elliptical motion while the other end is guided by a non-aligned drive link to drive an alternator and flywheel. The resulting pedal motion is foot friendly. Handles are coordinated with the foot support members for arm exercise. Adjustment is provided for the elliptical path.

20 Claims, 2 Drawing Sheets

ELLIPTICAL EXERCISE MACHINE

BACKGROUND OF THE INVENTION

1. Field

The present invention relates to a standup exercise apparatus that simulates walking, jogging and climbing with arm exercise. More particularly, the present invention relates to an exercise machine having separately supported pedals for the feet and arm exercise coordinated with the motion of the feet. The elliptical path provided by the pedals is adjustable.

2. State of the Art

The benefits of regular exercise to improve overall health, appearance and longevity are well documented in the literature. For exercise enthusiasts the search continues for safe apparatus that provides full body exercise for maximum benefit in minimum time.

Recently, a new category of exercise equipment has appeared on the commercial market called elliptical cross trainers. These cross trainers guide the feet along a generally elliptical shaped curve to simulate the motions of jogging and climbing. Generally they are large exercise machines using long cranks to generate a long foot stride. There is a need for an elliptical exercise machine capable of a similar long stride using a linkage to modify a shorter crank.

Standup pedal exercise combined with arm levers attached to the pedals is shown in Kummerlin et al. German Pat. No. 2,919,494 and in Geschwender U.S. Pat. No. 4,786,050. Standup pedal exercise coupled with oscillating swing arms is shown in Miller U.S. Pat. Nos. 5,242,343 and 5,383,829 and in Eschenbach U.S. Pat. No. 5,423,729. All of these exercise machines use pedals having two pedal pivots which are guided by a first circular guide path curve generated by a crank which rotates through one full revolution during a pedal cycle and a second arc guide path curve generated by a rocker link or track.

Eschenbach in U.S. Pat. No. 6,436,007 shows the use of a crank linkage in a front drive elliptical design. Maresh et al. in U.S. Pat. No. 5,997,445 shows elliptical exercise with an adjustable track supporting a roller positioned midway along the foot support member. Eschenbach in U.S. Pat. No. 6,168,552 also shows elliptical exercise with an adjustable track with a roller positioned intermediate the ends of a foot support member with arm exercise added. Eschenbach in U.S. Pat. No. 6,440,042 offers elliptical exercise having adjustable stride and adjustable ellipse orientation.

There is a need for a pedal operated exercise machine that can be safely operated in the standup position whereby the arms and legs can be exercised with the feet moving through a generally elliptical movement without excessive pedal articulation as well as adjustable ellipse.

It is one objective of this invention to provide an elliptical pedal movement with a path generating linkage that provides a long stride with less pedal articulation. Excessive pedal articulation causes ankle stress. Another object of this invention is to provide arm exercise that is coordinated with the pedal movement. Another objective of this invention is to provide a simple means of ellipse adjustment.

SUMMARY OF THE INVENTION

The present invention relates to the kinematic motion control of pedals which simulate running, climbing and cycling during several modes of operation. More particularly, apparatus is provided that offers variable intensity exercise through a leg operated cyclic motion in which the pedal supporting each foot is guided through successive positions during the motion cycle while a load resistance acts upon the mechanism.

The pedals are guided through an elongate curve motion while pedal angles vary during the pedal cycle to maintain the heel of the foot in contact with the pedal with less pedal articulation. As the foot is raised, the heel of the foot remains generally in contact with the inclining pedal for safer operation. Arm exercise is by arm levers coordinated with the mechanism guiding the foot pedals.

In the preferred embodiment, the apparatus includes a separate pedal for each foot, each pedal being positioned at one end of a foot support member and partially supported by an elongate guide path at the first portion of the foot support member. The elongate guide path generating linkage has a rotary crank arm which completes one full revolution during a pedal cycle and is phased generally opposite the crank arm for the other pedal through a crankshaft pivot axis attached to the framework. A rocker link is connected at a rocker pivot to the framework. A coupler link is connected to the crank at a crank arm pivot and the rocker link is connected to the coupler link at a pivot to form a crank-rocker mechanism where the rocker link oscillates about the rocker pivot when the crank rotates. A drive link is pivotally connected to the coupler link intermediate the ends of the coupler link and to the first portion of the foot support member. A connector link is pivotally connected to the drive link and to the rocker link. The combination of crank arm, coupling link, rocker link, connecting link and drive link form a path generating linkage with each end of the drive link following elongate curves.

A second portion of the foot support member is supported with a pivot by a roller positioned intermediate the foot support member and in rollable contact with a guide. As the crank arms are driven by foot motion, the pedals follows an elongate curve approximating an ellipse having less pedal articulation than other elliptical cross trainers having long crank arms.

Arm exercise is provided with handles pivotally connected to the framework and coordinated with the path generating linkages. When the foot is forward, the handle corresponding to that foot is generally rearward.

Load resistance is imposed upon the crank arms through pulleys and belts from a flywheel and alternator. A control system regulates the load on the alternator to vary the resistance to exercise. The resistance can be varied during operation through a control system within easy reach of the operator. Other forms of load resistance such as friction, magnetic, air, belt, etc. may also be used.

An adjustment is provided to adjust the position of the guides to change the elliptical path of the pedals. A manual adjustment is shown but an actuator with an adjustment linkage can also be used. The actuator would be changed with the control system.

In summary, this invention provides the operator with stable foot pedal support having motions that simulate running, climbing and cycling with very low joint impact and upper body exercise. The pedal motion exhibits a long stride with less pedal articulation common to other elliptical trainers for less ankle stress. Simple adjustment of the ellipse is provided.

DETAILED DESCRIPTION OF THE EMBODIMENTS

Figure 1:
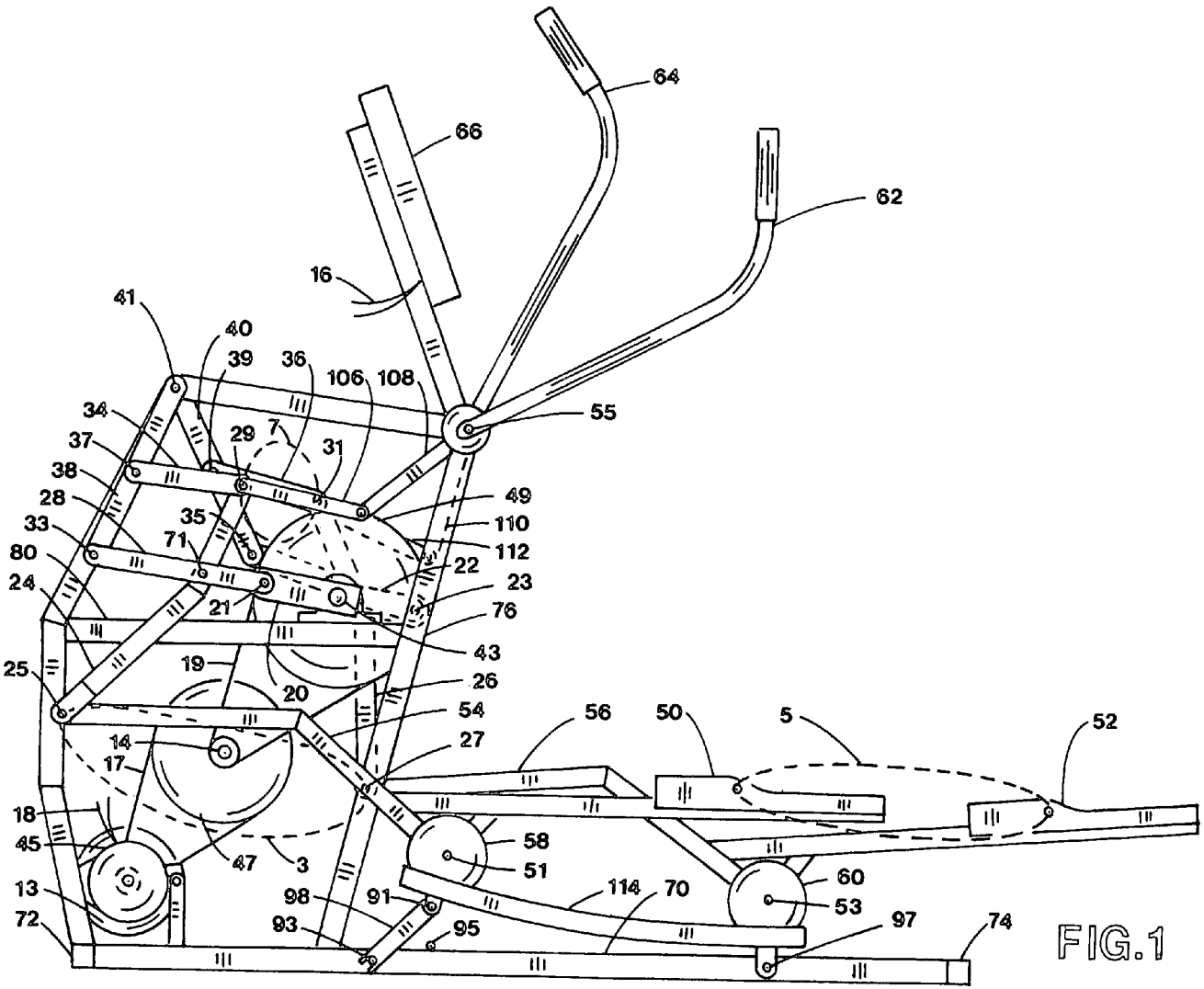
FIG. 1 is a right side elevation view of the preferred embodiment of an exercise machine constructed in accordance with the present invention.
Figure 2:
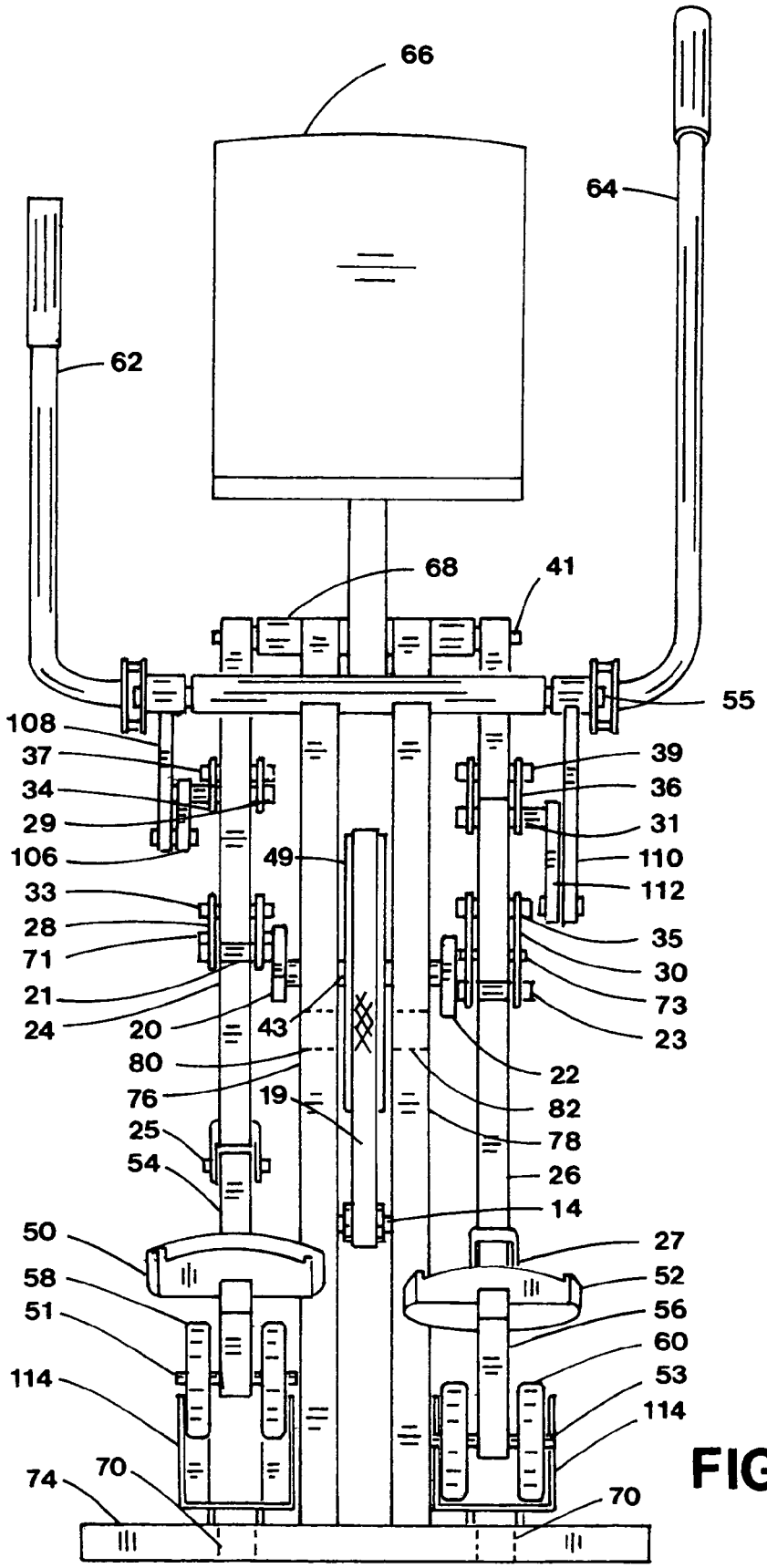
FIG. 2 is the rear view of the preferred embodiment shown in FIG. 1.

Referring to the drawings in detail, pedals 50 and 52 are shown in FIGS. 1 and 2 in the most forward and rearward positions of the preferred embodiment. Pedals 50 and 52 are supported by foot support members 54 and 56 and traverse an elongate closed loop path 5. Foot support members 54,56 are connected to drive links 24,26 at pivots 25,27 and supported by rollers 58,60 positioned intermediate the ends at pivots 51,53. Rollers 58,60 are in rollable contact with guides 114.

Crank arms 20,22 are joined as generally opposed at pivot axis 43 to form a crank. Rocker links 38,40 are connected to the framework 76,78 at pivot 41. Coupler links 28,30 are connected to crank arm pivots 21,23 at one end and to rockers 38,40 at the other end with pivots 33,35. Drive links 24,26 are connected to coupler links 28,30 intermediate the ends at pivots 71,73.

Connector links 34,36 are connected to rocker links 38,40 at pivots 37,39 and to drive links 24,26 at pivots 29,31. Drive links 24,26, cranks arms 20,22, rocker links 38,40, coupler links 28,30 and connector links 34,36 form a pair of path generating linkages configured to guide the first portion of the foot support member 54,56 proximate pivots 25,27 along an elongate path 3. Pivots 29,31 on drive links 24,26 also follow elongate path 7. Drive links 24,26 are shown nonaligned with three pivots 25,71,29 and 27,73,31 each such that a line drawn through two of the pivots does not contain the third pivot. For this embodiment, note that the elongate path 3 followed by the end of foot support members 54,56 does not orbit pivot axis 43.

Handles 62,64 are connected to frame member 68 at pivot 55 for arm exercise. Handle links 108,110 are attached to handles 62,64 and pivotally connected to handle connectors 106,112. Handle connectors 106,112 are connected to connector links 34,36 at pivots 29,31.

Pulley 49 is attached to crank arms 20,22 and rotates about pivot axis 43 to drive alternator 45 and flywheel 13 through belts 17,19 and step-up pulley 47. Alternator 45 is supported by frame 76,78 and is connected to controller 66 by wires 16,18 using conventional wiring (not shown). Controller 66 is attached to frame member 68 and works with alternator 45 to provide variable resistance to exercise using conventional methods.

Crank pivot axis 43 is supported by frame members 80,82 which are attached to frame members 76,78 which attach to frame members 70. Cross members 72,74 are supported by the floor and attach to frame members 70. Pulley 47 is supported by a pulley supports 80,82 at pivot 14 which are attached to frame member 76,78. Frame member 68 is attached to frame members 76,78 to support handle pivot 55.

Guide tracks 114 are connected to frame members 70 at pivot 97 and supported by support bar 98. Support bar 98 is attached to guide tracks 114 at pivots 91 and pins 93 which are attached to frame members 70. Alternate pins 95 attached to frame members 70 are available to reposition support bars 98 to change the pedal path curve 5 manually. Guide tracks 114 are shown curved but can also be straight. An actuator (not shown) controlled by the control system could also be used to change the position of guide tracks 114.

The present invention may be embodied in other specific forms without departing from its spirit or essential characteristics. The described embodiments are to be considered in all respects only as illustrative, and not restrictive. The scope of the invention is, therefore, indicated by the claims, rather than by foregoing description. All changes which come within the meaning and range of equivalency of the claims are to be embraced within their scope.

What is claimed is:

1. An exercise machine comprising:

a framework, said framework configured to be supported by the floor;

a pair of foot support members, each having a first portion, a second portion and a foot engaging pedal;

a crank having a pair of crank arms rotatably attached to said framework and projecting outwardly therefrom on both sides thereof;

a pair of rocker links, each said rocker link configured to oscillate about a rocker pivot;

a pair of coupler links, each said coupler link pivotally connected to a corresponding said crank arm and a corresponding said rocker link;

a pair of drive links, each drive link pivotally connected to a corresponding said coupler link;

a pair of connector links, each said connector link pivotally connected to a corresponding said rocker link and a corresponding said drive link;

a pair of path generating linkages, each said linkage including said drive link, said crank, said rocker link, said coupler link and said connecting link configured to guide said first portion of said foot support member along an elongate path;

a pair of rollers, each said roller positioned in said second portion of said foot support member intermediate the ends;

a pair of guides, each said guide connected to said frame and in rollable contact with said roller to cause said second portion of said foot support member to have a back and forth movement;

said pedal configured to move relative to said framework when the foot of the user is rotating said crank whereby said pedal follows an elongate curve path.

2. The exercise machine according to claim 1 wherein said elongate curve path is generally elliptical in shape.

3. The exercise machine according to claim 1 further comprising arm exercise structure, said arm exercise structure operably associated with said linkage.

4. The exercise machine according to claim 3 wherein said arm exercise further comprises a pair of handles, each said handle pivotally connected to said framework.

5. The exercise machine according to claim 1 further comprising a flywheel, said flywheel rotatably connected to said framework and operably associated with said crank.

6. The exercise machine according to claim 5 further comprising a load resistance, said load resistance operably associated with said flywheel, a means for adjustment of said load resistance and, a control system, said control system positioned within reach of the operator whereby said load resistance can be varied during operation of said exercise machine.

7. The exercise machine according to claim 1 further comprising an adjustment, said adjustment operably associated with said guide and said framework to adjust said elongate curve pedal path.

8. The exercise machine according to claim 7 wherein said adjustment is comprised of movable guide tracks, said movable guide tracks capable of being repositioned to change said elongate curve path.

9. The exercise machine according to claim 1 wherein said drive link contains at least three pivots, said three pivots configured such that a line connecting the two most distal said pivots does not contain the third pivot.

10. The exercise machine according to claim 1 wherein said guide is composed of a curved track, said curve track operably associated with said roller and said framework.

11. The exercise machine according to claim 1 wherein said drive link is nonaligned, said nonaligned drive link being a portion of said path generating linkage.

12. An exercise machine comprising:

a framework, said framework configured to be supported by the floor;

a pair of foot support members, each having a first portion, a second portion and a foot engaging pedal;

a crank having a pair of crank arms rotatably attached to said framework and projecting outwardly therefrom on both sides thereof;

a pair of rocker links, each said rocker link configured to oscillate about a rocker pivot;

a pair of coupler links, each said coupler link pivotally connected to a corresponding said crank arm and a corresponding said rocker link;

a pair of nonaligned drive links, each nonaligned drive link pivotally connected to a corresponding said coupler link and configured such that each end of said nonaligned drive link follows an elongate path;

a pair of connector links, each said connector link pivotally connected to a corresponding said rocker link and a corresponding said nonaligned drive link;

a pair of path generating linkages, each said linkage including said nonaligned drive link, said crank, said rocker link, said coupler link and said connecting link configured to guide said first portion of said foot support member along an elongate path;

a pair of rollers, each said roller positioned in said second portion of said foot support member intermediate the ends;

a pair of guides, each said guide connected to said frame and in rollable contact with said roller to cause said second portion of said foot support member to have a back and forth movement;

said pedal configured to move relative to said framework when the foot of the user is rotating said crank whereby said pedal follows an elongate curve path.

13. The exercise machine according to claim 12 further comprising a load resistance, said load resistance operably associated with said crank, a means for adjustment of said load resistance and, a control system, said control system positioned within reach of the operator whereby said load resistance can be varied during operation of said exercise machine.

14. The exercise machine according to claim 12 further comprising arm exercise structure, said arm exercise structure operably associated with said path generating linkages.

15. The exercise machine according to claim 12 further comprising an adjustment structure, said adjustment structure operably associated with said guide and said framework to adjust said elongate curve pedal path.

16. An exercise machine comprising:

a framework, said framework configured to be supported by the floor;

a pair of foot support members, each having a first portion, a second portion and a foot engaging pedal;

a crank having a pair of crank arms rotatably attached to said framework and projecting outwardly therefrom on both sides thereof;

a pair of rocker links, each said rocker link configured to oscillate about a rocker pivot;

a pair of coupler links, each said coupler link pivotally connected to a corresponding said crank arm and a corresponding said rocker link;

a pair of drive links, each drive link pivotally connected to a corresponding said coupler link and configured such that each end of said drive link follows an elongate path;

a pair of connector links, each said connector link pivotally connected to a corresponding said rocker link and a corresponding said drive link;

a pair of path generating linkages, each said linkage including said drive link, said crank, said rocker link, said coupler link and said connecting link configured to guide said first portion of said foot support member along an elongate path;

a pair of rollers, each said roller positioned in said second portion of said foot support member intermediate the ends;

a pair of curved guides, each said curved guide connected to said frame and in rollable contact with said roller to cause said second portion of said foot support member to have a back and forth movement;

a pair of handles, each said handle pivotally connected to said framework for arm exercise;

said pedal configured to move relative to said framework when the foot of the user is rotating said crank whereby said pedal follows an elongate curve path.

17. The exercise machine according to claim 16 wherein said handles are operably associated with said path generating linkages.

18. The exercise machine according to claim 16 further comprising a load resistance, said load resistance operably associated with said crank, a means for adjustment of said load resistance and, a control system, said control system positioned within reach of the operator whereby said load resistance can be varied during operation of said exercise machine.

19. The exercise machine according to claim 16 further comprising an adjustment structure, said adjustment structure operably associated with said curved guide and said framework to adjust said elongate curve pedal path.

20. The exercise machine according to claim 16 wherein said drive link contains at least three pivots, said three pivots configured such that a line connecting the two most distal said pivots does not contain the third pivot.

* * * * *